US011180835B2

(12) United States Patent
Ueda et al.

(10) Patent No.: US 11,180,835 B2
(45) Date of Patent: Nov. 23, 2021

(54) STEEL SHEET

(71) Applicant: NIPPON STEEL & SUMITOMO METAL CORPORATION, Tokyo (JP)

(72) Inventors: Kohei Ueda, Tokyo (JP); Hiroyuki Kawata, Tokyo (JP); Takayuki Kitazawa, Tokyo (JP); Takeshi Yasui, Tokyo (JP); Hiroyuki Ban, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 163 days.

(21) Appl. No.: 15/757,264

(22) PCT Filed: Sep. 25, 2015

(86) PCT No.: PCT/JP2015/077148
§ 371 (c)(1),
(2) Date: Mar. 2, 2018

(87) PCT Pub. No.: WO2017/051477
PCT Pub. Date: Mar. 30, 2017

(65) Prior Publication Data

US 2018/0274069 A1 Sep. 27, 2018

(51) Int. Cl.
*C22C 38/38* (2006.01)
*C21D 9/46* (2006.01)
(Continued)

(52) U.S. Cl.
CPC ..... *C22C 38/38* (2013.01); *C21D 6/002* (2013.01); *C21D 6/005* (2013.01); *C21D 6/008* (2013.01);
(Continued)

(58) Field of Classification Search
CPC ..... C22C 38/001; C22C 38/002; C22C 38/00; C22C 38/005; C22C 38/02–08;
(Continued)

(56) References Cited

U.S. PATENT DOCUMENTS

2009/0308498 A1 12/2009 Matsumura et al.
2012/0186707 A1 7/2012 Hirasawa et al.
(Continued)

FOREIGN PATENT DOCUMENTS

CN 101583740 A 11/2009
CN 102482728 A 5/2012
(Continued)

OTHER PUBLICATIONS

Gibson R. "Bright Annealing Technical Data Sheet", Retrieved Feb. 24, 2021; URL http://www-eng.lbl.gov/~shuman/NEXT/MATERIALS&COMPONENTS/Pressure_vessels/BrightAnnealing_TechSheet_sfs.pdf (Year: 2021).*
(Continued)

*Primary Examiner* — Alexandra M Moore
*Assistant Examiner* — Austin Pollock
(74) *Attorney, Agent, or Firm* — Birch, Stewart, Kolasch & Birch, LLP

(57) ABSTRACT

A steel sheet has a predetermined chemical composition, and a surface exhibits an absorption peak at which a reflectance is not less than 50% nor more than 85% in a range of wave numbers of 1200 $cm^{-1}$ to 1300 $cm^{-1}$ by a Fourier transform-infrared spectroscopy analysis by a reflection absorption spectrometry method, and does not exhibit an absorption peak in a range of wave numbers of 1000 $cm^{-1}$ to 1100 $cm^{-1}$, or exhibits an absorption peak at which a reflectance is 85% or more in the range of wave numbers of 1000 $cm^{-1}$ to 1100 $cm^{-1}$, wherein Ni of 3 $mg/m^2$ to 100 $mg/m^2$ adheres to the surface.

2 Claims, 2 Drawing Sheets

(51) Int. Cl.

| | |
|---|---|
| ***C21D 6/00*** | (2006.01) |
| ***C21D 8/02*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/08*** | (2006.01) |
| ***C22C 38/12*** | (2006.01) |
| ***C22C 38/16*** | (2006.01) |
| ***C22C 38/22*** | (2006.01) |
| ***C22C 38/28*** | (2006.01) |
| ***C23F 17/00*** | (2006.01) |
| ***C23G 1/08*** | (2006.01) |
| ***C25D 3/12*** | (2006.01) |
| ***C25D 5/36*** | (2006.01) |

(52) U.S. Cl.
CPC ..... *C21D 8/0205* (2013.01); *C21D 8/0226* (2013.01); *C21D 8/0236* (2013.01); *C21D 8/0278* (2013.01); *C21D 9/46* (2013.01); *C22C 38/001* (2013.01); *C22C 38/002* (2013.01); *C22C 38/02* (2013.01); *C22C 38/04* (2013.01); *C22C 38/06* (2013.01); *C22C 38/08* (2013.01); *C22C 38/12* (2013.01); *C22C 38/16* (2013.01); *C22C 38/22* (2013.01); *C22C 38/28* (2013.01); *C23F 17/00* (2013.01); *C23G 1/08* (2013.01); *C25D 3/12* (2013.01); *C25D 5/36* (2013.01)

(58) Field of Classification Search
CPC ..... C22C 38/12–28; C22C 38/32–34; C22C 38/38–50; C22C 38/54; C22C 38/58; C22C 38/60; C21D 6/002; C21D 6/005; C21D 6/008; C21D 8/0205; C21D 8/0226; C21D 8/0236; C21D 8/0278; C21D 9/46; C23F 17/00; C23G 1/08; C23G 1/02; C25D 3/12; C25D 5/36
USPC ..... 420/84; 148/320
See application file for complete search history.

(56) References Cited

U.S. PATENT DOCUMENTS

| | | | | |
|---|---|---|---|---|
| 2012/0325376 | A1* | 12/2012 | Makimizu | C21D 9/561 148/284 |
| 2014/0377582 | A1* | 12/2014 | Azuma | C23C 2/02 428/632 |
| 2016/0053355 | A1* | 2/2016 | Takagi | C22C 38/00 148/637 |
| 2018/0037969 | A1* | 2/2018 | Yoshioka | C21D 6/008 |
| 2018/0237876 | A1* | 8/2018 | Hecht | C21D 8/1266 |

FOREIGN PATENT DOCUMENTS

| | | | | |
|---|---|---|---|---|
| EP | 0 496 423 | A1 | 7/1992 | |
| EP | 0496423 | A1 * | 7/1992 | C25D 5/48 |
| JP | 4-247849 | A | 9/1992 | |
| JP | 2003-201538 | A | 7/2003 | |
| JP | 2004-323969 | A | 11/2004 | |
| JP | 2005-307283 | A | 11/2005 | |
| JP | 2008-121045 | A | 5/2008 | |
| JP | 2009-221566 | A | 10/2009 | |
| JP | 2010-47808 | A | 3/2010 | |
| JP | 2010-53371 | A | 3/2010 | |
| JP | 2010-53446 | A | 3/2010 | |
| JP | 2010053446 | A * | 3/2010 | |
| JP | 2010-90441 | A | 4/2010 | |
| JP | 2012-122088 | A | 6/2012 | |
| JP | 2013-237924 | A | 11/2013 | |
| JP | 2013237924 | A * | 11/2013 | |
| JP | 2013-253322 | A | 12/2013 | |
| JP | 2014-95134 | A | 5/2014 | |
| JP | 2014-189797 | A | 10/2014 | |
| JP | 2014189797 | A * | 10/2014 | A61B 8/14 |
| WO | WO-2013118679 | A1 * | 8/2013 | |
| WO | WO-2014156187 | A1 * | 10/2014 | |

OTHER PUBLICATIONS

International Search Report for PCT/JP2015/077148 dated Dec. 15, 2015.
Written Opinion of the International Searching Authority for PCT/JP2015/077148 (PCT/ISA/237) dated Dec. 15, 2015.
International Preliminary Report on Patentability and English translation of the Written Opinion of the International Searching Authority (Forms PCT/IB/338, PCT/IB/373 and PCT/ISA/237), dated Apr. 5, 2018, for International Application No. PCT/JP2015/077148.
Extended European Search Report dated Feb. 15, 2019, for corresponding European Application No. 15904734.9.

* cited by examiner

STEEL SHEET

TECHNICAL FIELD

The present invention relates to a steel sheet capable of obtaining excellent conversion treatability.

BACKGROUND ART

In recent years, as purposes of a weight reduction of a vehicle body aiming at a fuel consumption reduction and a reduction in an emission amount of $CO_2$, and an improvement in collision safety, in an automotive sector, a demand that a high-strength cold-rolled steel sheet is used for a vehicle body and parts is increasing.

The high-strength cold-rolled steel sheet is molded in a large amount and in an inexpensive manner by press work similarly to a mild steel sheet and used as various members. Therefore, the high-strength cold-rolled steel sheet also requires high ductility and good workability. Moreover, in general, for the high-strength cold-rolled steel sheet, conversion treatment such as zinc phosphate treatment is performed in order to improve corrosion resistance and coating film adhesiveness. In the conversion treatment, for example, a zinc phosphate coating film of about 2 $g/m^2$ to 3 $g/m^2$ is formed. A Zr-based coating film is sometimes formed in the conversion treatment. In addition, cationic electrodeposition paint is often performed on these coating films (conversion treatment layer). When the cationic electrodeposition coating is performed, a surface of the conversion treatment layer is exposed to strong alkalinity. Therefore, the conversion treatment layer is desired to have alkali resistance. As an index indicating this alkali resistance, a parameter referred to as a P ratio is utilized. As phosphate included in the conversion treatment layer, hopeite constituted of Zn—P—O and phosphophyllite constituted of Zn—Fe—P—O can be cited. Phosphophyllite is a reaction product of Fe in the steel sheet and zinc phosphate. The P ratio is found from peak intensity obtained by an X-ray diffractometer. The peak intensity of hopeite appears at an angle of diffraction of $2\theta=14.55°$, and the peak intensity of phosphophyllite appears at an angle of diffraction of $2\theta=14.88$. When the X-ray peak intensity at 14.55° is set as H and the X-ray peak intensity at 14.88° is set as P, the P ratio is indicated by "P/(P+H)". Phosphophyllite exhibits more excellent alkali resistance than hopeite. Consequently, the higher the P ratio is, the higher alkali resistance can be obtained.

In general, the higher a content of Si and Mn is, the more easily the high ductility and the good workability are obtained. However, Si and Mn contained in steel are easily oxidized. Accordingly, when an attempt is made to manufacture the high-strength cold-rolled steel sheet by using the steel containing much Si and Mn, Si and Mn are oxidized during annealing in the above process and an oxide is formed on a surface of the high-strength cold-rolled steel sheet. The oxide formed on the surface reduces the conversion treatability and the corrosion resistance.

Accordingly, when the content of Si and Mn is increased in order to obtain the high ductility and the good workability, it is difficult to obtain good conversion treatability and corrosion resistance. For example, the zinc phosphate coating film is formed by crystallization of zinc phosphate, but when the conversion treatability is low, zinc phosphate does not easily adhere to the surface of the steel sheet, and a portion in which the conversion treatment layer is not formed sometimes occurs. In addition, a reaction between Fe in the steel sheet and zinc phosphate is inhibited by the oxide and phosphophyllite is not easily produced, and sufficient alkali resistance is not sometimes obtained. As a result of these, the cationic electrodeposition coating cannot be appropriately performed after the conversion treatment, so that good corrosion resistance is not obtained.

Conventionally, various proposals aiming at an improvement in the conversion treatability or the corrosion resistance, or both of these have been made (Patent Literatures 1 to 9). However, in conventional techniques, it is difficult to improve the conversion treatability sufficiently, or even though the conversion treatability is improved, concomitantly with the above, the corrosion resistance is reduced, and tensile strength and fatigue strength are reduced.

CITATION LIST

Patent Literature

Patent Literature 1: Japanese Laid-open Patent Publication No. 2004-323969

Patent Literature 2: Japanese Laid-open Patent Publication No. 2009-221586

Patent Literature 3: Japanese Laid-open Patent Publication No. 2010-47808

Patent Literature 4: Japanese Laid-open Patent Publication No. 2010-53371

Patent Literature 5: Japanese Laid-open Patent Publication No. 2012-122086

Patent Literature 6: Japanese Laid-open Patent Publication No. 2008-121045

Patent Literature 7: Japanese Laid-open Patent Publication No. 2005-307283

Patent Literature 8: Japanese Laid-open Patent Publication No. 2010-90441

Patent Literature 9: Japanese Laid-open Patent Publication No. 04-247849

SUMMARY OF INVENTION

Technical Problem

An object of the present invention is to provide a steel sheet capable of obtaining excellent conversion treatability while avoiding a reduction in corrosion resistance and a reduction in strength.

Solution to Problem

The present inventors have conducted keen studies in order to solve the above-described problem. As a result, the following matters have been proved.

(a) An oxide existing on a surface of a steel sheet containing much Si and Mn is silica and manganese silicate.

(b) Manganese silicate can be removed easily by an acid with a degree to which pitting does not occur in the steel sheet, but silica cannot be removed by the acid with the degree to which the pitting does not occur in the steel sheet.

(c) Silica remaining after pickling can be roughly divided into dense silica and porous silica.

(d) Dense silica has more excellent conversion treatability than manganese silicate and porous silica.

(e) Even though porous silica remains, porous silica is covered with Ni by performing Ni electrolytic plating and conversion treatability is improved.

The inventors of the present application have further conducted keen studies based on the above observation, and consequently have conceived embodiments of the invention described below.

(1)

A steel sheet includes a chemical composition represented by, in mass %,

C: 0.050% to 0.400%,

Si: 0.10% to 2.50%,

Mn: 1.20% to 3.50%,

P: 0.100% or less,

Al: 1.200% or less,

N: 0.0100% or less,

Cr, Mo, Ni and Cu: 0.00% to 1.20% in total,

Nb, Ti and V: 0.000% to 0.200% in total,

B: 0.0000% to 0.0075%,

Ca, Mg, Ce, Hf, La, Zr, Sb and REM: 0.0000% to 0.1000% in total, and the balance: Fe and impurities, in which a surface exhibits an absorption peak at which a reflectance is not less than 50% nor more than 85% in a range of wave numbers of 1200 $cm^{-1}$ to 1300 $cm^{-1}$ by a Fourier transform-infrared spectroscopy analysis by a reflection absorption spectrometry method, and does not exhibit an absorption peak in a range of wave numbers of 1000 $cm^{-1}$ to 1100 $cm^{-1}$, or exhibits an absorption peak at which a reflectance is 85% or more in the range of wave numbers of 1000 $cm^{-1}$ to 1100 $cm^{-1}$, wherein Ni of 3 $mg/m^2$ to 100 $mg/m^2$ adheres to the surface.

(2)

The steel sheet according to (1), wherein the surface exhibits an absorption peak at which a reflectance is not less than 60% nor more than 85% in the range of wave numbers of 1200 $cm^{-1}$ to 1300 $cm^{-1}$ by the Fourier transform-infrared spectroscopy analysis by the reflection absorption spectrometry method.

Advantageous Effects of Invention

According to the present invention, it is possible to obtain excellent conversion treatability without performing such treatment that a reduction in corrosion resistance and a reduction in strength occur.

DESCRIPTION OF EMBODIMENTS

Figure 1:
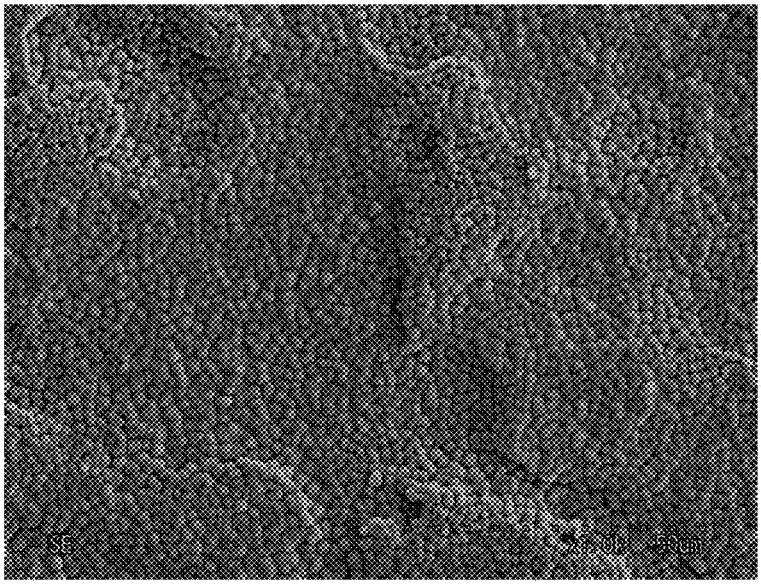
FIG. 1 is a view illustrating a sample in which a degree of adhesion of a crystal of zinc phosphate is particularly good.

Hereinafter, an embodiment of the present invention will be described.

First, a chemical composition of steel to be used for a steel sheet according to the embodiment of the present invention and manufacture thereof will be described. Although details are described later, the steel sheet according to the embodiment of the present invention is manufactured through hot rolling, pickling after hot rolling, cold rolling, annealing, pickling after annealing, plating, and the like of the steel. Accordingly, the chemical composition of the steel sheet and the steel is in consideration of not only a property of the steel sheet but also these processes. In the following description, "%" which is a unit of a content of each element included in the steel sheet means "mass %" unless otherwise stated. The steel sheet according to this embodiment has a chemical composition represented by C: 0.050% to 0.400%, Si: 0.10% to 2.50%, Mn: 1.20% to 3.50%, P: 0.100% or less, Al: 1.200% or less, N: 0.0100% or less, Cr, Mo, Ni and Cu: 0.00% to 1.20% in total, Nb, Ti and V: 0.000% to 0.200% in total, B: 0.0000% to 0.0075%, Ca, Mg, Ce, Hf, La, Zr, Sb and rare earth metal (REM): 0.0000% to 0.1000% in total, and the balance: Fe and impurities. As the impurities, the ones included in raw materials such as ore and scrap and the ones included in a manufacturing process are exemplified.

(C: 0.050% to 0.400%)

C is an element which forms a hard structure such as martensite, tempered martensite, bainite, and retained austenite and improves strength of the steel sheet. When a C content is less than 0.050%, an effect according to this action cannot be sufficiently obtained. Accordingly, the C content is 0.050% or more. In order to obtain higher strength, the C content is preferably 0.075% or more. On the other hand, when the C content is more than 0.400%, sufficient weldability cannot be obtained. Accordingly, the C content is 0.400% or less.

(Si: 0.10% to 2.50%)

Si is an element which improves the strength while securing good workability. When a Si content is less than 0.10%, an effect according to this action cannot be sufficiently obtained. Accordingly, the Si content is 0.10% or more. In order to obtain higher strength while securing the good workability, the Si content is preferably 0.45% or more, and more preferably 0.86% or more. On the other hand, when the Si content is more than 2.50%, toughness is reduced, and workability conversely deteriorates. Accordingly, the Si content is 2.50% or less.

(Mn: 1.20% to 3.50%)

Mn is an element which improves the strength while securing the good workability similarly to Si. When a Mn content is less than 1.20%, an effect according to this action cannot be sufficiently obtained. Accordingly, the Mn content is 1.20% or more. In order to obtain higher strength while securing the good workability, the Mn content is preferably 1.50% or more. On the other hand, when the Mn content is more than 3.50%, the sufficient weldability cannot be obtained. Accordingly, the Mn content is 3.50% or less.

(P: 0.100% or Less)

P is not an essential element and is contained as an impurity in the steel, for example. From the viewpoint of the workability, the weldability, and fatigue characteristics, a P content as low as possible is preferable. When the P content is more than 0.100% in particular, a reduction in the workability, the weldability, and the fatigue characteristics is remarkable. Accordingly, the P content is set to 0.100% or less.

(Al: 1.200% or Less)

Al is not an essential element and is contained as an impurity in the steel, for example. From the viewpoint of the workability, an Al content as low as possible is preferable. When the Al content is more than 1.200% in particular, a reduction in the workability is remarkable. Accordingly, the Al content is set to 1.200% or less.

(N: 0.0100% or Less)

N is not an essential element and is contained as an impurity in the steel, for example. From the viewpoint of the workability, a N content as low as possible is preferable. When the N content is more than 0.0100% in particular, a reduction in the workability is remarkable. Accordingly, the N content is set to 0.0100% or less.

(Cr, Mo, Ni and Cu: 0.00% to 1.20% in Total)

Cr, Mo, Ni and Cu contribute to a further improvement in the strength of the steel sheet. Accordingly, Cr, Mo, Ni or Cu, or an optional combination of these may be contained. However, when a content of Cr, Mo, Ni and Cu is more than 1.20% in total, this effect is saturated and a cost becomes uselessly high. In addition, when the content of Cr, Mo, Ni and Cu is more than 1.20% in total, cast slab cracking occurs at a time of casting and the manufacture for the steel sheet is sometimes impossible. Accordingly, the content of Cr, Mo, Ni and Cu is 1.20% or less in total.

(Nb, Ti and V: 0.000% to 0.200% in Total)

Nb, Ti and V contribute to a further improvement in the strength of the steel sheet. Accordingly, Nb, Ti or V, or an optional combination of these may be contained. However, when a content of Nb, Ti and V is more than 0.200% in total, this effect is saturated and the cost becomes uselessly high. In addition, when the content of Nb, Ti and V is more than 0.200% in total, the sufficient weldability cannot be sometimes obtained. Accordingly, the content of Nb, Ti and V is 0.200% or less in total.

(B: 0.0000% to 0.0075%)

B contributes to a further improvement in the strength of the steel sheet. Accordingly, B may be contained. However, when a B content is more than 0.0075%, this effect is saturated and the cost becomes uselessly high. In addition, when the B content is more than 0.0075%, the cast slab cracking occurs at the time of casting and the manufacture for the steel sheet is sometimes impossible. Accordingly, the B content is 0.0075% or less.

(Ca, Mg, Ce, Hf, La, Zr, Sb and REM: 0.0000% to 0.1000% in Total)

Ca, Mg, Ce, Hf, La, Zr, Sb and REM contribute to an improvement in formability of the steel sheet. Accordingly, Ca, Mg, Ce, Hf, La, Zr, Sb or REM, or an optional combination of these may be contained. However, when a content of Ca, Mg, Ce, Hf, La, Zr, Sb and REM is more than 0.1000% in total, this effect is saturated and the cost becomes uselessly high. In addition, when a content of Ca, Mg, Ce, Hf, La, Zr, Sb and REM is more than 0.1000% in total, the cast slab cracking occurs at the time of casting and the manufacture for the steel sheet is sometimes impossible. Accordingly, the content of Ca, Mg, Ce, Hf, La, Zr, Sb and REM is 0.1000% or less in total.

REM indicates total 17 types of elements of Sc, Y and lanthanoid, and a content of REM means a total content of these 17 types of elements. Lanthanoid is industrially added as misch metal, for example.

Next, a surface of the steel sheet according to the embodiment of the present invention will be described. The surface of the steel sheet according to this embodiment exhibits an absorption peak at which a reflectance is not less than 50% nor more than 85% and preferably not less than 60% nor more than 85% in a range of wave numbers of 1200 $cm^{-1}$ to 1300 $cm^{-1}$ by a Fourier transform-infrared spectroscopy analysis by a reflection absorption spectrometry method. Moreover, the surface of the steel sheet according to this embodiment does not exhibit an absorption peak in a range of wave numbers of 1000 $cm^{-1}$ to 1100 $cm^{-1}$, or exhibits an absorption peak at which a reflectance is 85% or more in the range of wave numbers of 1000 $cm^{-1}$ to 1100 $cm^{-1}$. Further, Ni of 3 $mg/m^2$ to 100 $mg/m^2$ adheres to the surface of the steel sheet according to this embodiment.

As described above, the steel sheet according to this embodiment is manufactured through the hot rolling, the pickling after hot rolling, the cold rolling, the annealing, the pickling after annealing, Ni electrolytic plating, and the like of the steel. At a time of the annealing, an oxide is produced on a surface of a cold-rolled steel sheet obtained by the cold rolling, and the oxide exists on a surface of an annealed steel sheet obtained by the annealing. This is because Si and Mn are substances to be easily oxidized and therefore Si and Mn are oxidized selectively near the surface of the cold-rolled steel sheet. This oxide is silica and manganese silicate. Because manganese silicate is easily dissolved in acid, it can be removed easily by an acid with a degree to which pitting does not occur, but silica cannot be removed by the acid with the degree to which the pitting does not occur in the cold-rolled steel sheet. Accordingly, when the pickling after annealing is performed by using such an acid, part or the whole of manganese silicate is removed and silica remains. Silica existing after the pickling after annealing can be roughly divided into dense silica and porous silica. When Ni is made to adhere to the annealed steel sheet by electrolytic plating in a state in which dense silica and porous silica exist, porous silica is covered with Ni. Ni also adheres to a portion in which silica does not exist in the annealed steel sheet, namely a surface of a base material. Accordingly, silica exists on the surface of the steel sheet according to this embodiment, and Ni adheres to the surface of silica and the base material.

Manganese silicate inhibits conversion treatability and is easy to dissolve in an acid atmosphere. In addition, a barrier property of manganese silicate to corrosion factors is low. Therefore, when much manganese silicate exists on the surface of the steel sheet, good conversion treatability cannot be obtained and a conversion treatment layer cannot be appropriately formed either, and therefore good corrosion resistance cannot be obtained. Silica can be roughly divided into dense silica and porous silica, and dense silica has the good conversion treatability and also has an excellent barrier property to the corrosion factors. A barrier property of porous silica to the corrosion factors is lower than that of dense silica, but Ni adheres to porous silica by the electrolytic plating, thereby allowing the good conversion treatability to be obtained.

An absorption peak appearing in the range of 1200 $cm^{-1}$ to 1300 $cm^{-1}$ by the Fourier transform-infrared spectroscopy (FT-IR) analysis by the reflection absorption spectrometry (RAS) method indicates the presence of silica. As described above, in manufacturing the steel sheet according to this embodiment, silica and manganese silicate are produced in the annealing, and part or the whole of manganese silicate is removed by the pickling after annealing, but silica is made to remain in order to suppress occurrence of the pitting. Therefore, in this embodiment, silica exists on the surface of the steel sheet and the surface exhibits the absorption peak in the range of wave numbers of 1200 $cm^{-1}$ to 1300 $cm^{-1}$. The reflectance in a wave number indicating this absorption peak indicates to what degree silica exists, and the lower this reflectance is, the higher an absorptance of infrared rays is, which indicates that much silica exists. Then, when this reflectance is less than 50%, silica exists excessively, so that porous silica is not sufficiently covered with Ni, thereby not allowing good conversion treatability to be obtained. On the other hand, in order to set this reflectance to more than 85%, it is necessary to decrease a production amount of silica in the annealing or to increase a removal amount of silica in the pickling after annealing. In order to decrease the production amount of silica in the annealing, it is necessary to increase a dew point in a furnace at the time of the annealing, so that remarkable decarburization occurs and tensile strength and fatigue strength are reduced. In order to increase the removal amount of silica, it is necessary to perform strong pickling, so that remarkable pitting occur and bending workability is reduced. That is, when this reflectance is more than 85%, a desirable mechanical property cannot be obtained. Accordingly, the surface of the steel sheet exhibits an absorption peak at which a reflectance is not less than 50% nor more than 85% and preferably not less than 60% nor more than 85% in the range of wave numbers of 1200 $cm^{-1}$ to 1300 $cm^{-1}$ by the FT-IR analysis by the RAS method. Hereinafter, "FT-IR analysis by RAS method" is sometimes simply referred to as "FT-IR analysis".

The absorption peak appearing in the range of wave numbers of 1000 $cm^{-1}$ to 1100 $cm^{-1}$ by the FT-IR analysis indicates the presence of manganese silicate. Since manganese silicate reduces the conversion treatability, it is preferably as little as possible. Accordingly, the surface of the steel sheet preferably does not exhibit the absorption peak in the range of wave numbers of 1000 $cm^{-1}$ to 1100 $cm^{-1}$ by the FT-IR analysis. Even though it exhibits the absorption peak in the range of wave numbers of 1000 $cm^{-1}$ to 1100 $cm^{-1}$, a small amount of manganese silicate is allowable as long as the reflectance in a wave number indicating this absorption peak is 85% or more. On the other hand, when the reflectance in the wave number indicating the absorption peak appearing in the range of wave numbers of 1000 $cm^{-1}$ to 1100 $cm^{-1}$ is less than 85%, manganese silicate exists excessively, so that the good conversion treatability cannot be obtained, in addition, since the conversion treatment layer cannot be appropriately formed, the good corrosion resistance cannot be obtained. Accordingly, the surface of the steel sheet does not exhibit the absorption peak in the range of wave numbers of 1000 $cm^{-1}$ to 1100 $cm^{-1}$ by the FT-IR analysis, or it exhibits the absorption peak at which the reflectance is 85% or more in the range of wave numbers of 1000 $cm^{-1}$ to 1100 $cm^{-1}$.

Ni adhering to the surface of the steel sheet according to this embodiment covers porous silica to improve the conversion treatability. When an adhesion amount of Ni is less than 3 $mg/m^2$, sufficient conversion treatability cannot be obtained. Accordingly, the adhesion amount of Ni is 3 $mg/m^2$ or more. In order to obtain more excellent conversion treatability, the adhesion amount of Ni is preferably 10 $mg/m^2$ or more, and more preferably 40 $mg/m^2$ or more. On the other hand, when the adhesion amount of Ni is more than 100 $mg/m^2$, more valuable Ni than Fe which is a main component of the steel sheet is excessive, so that sufficient corrosion resistance cannot be obtained. Accordingly, the adhesion amount of Ni is 100 $mg/m^2$ or less. In order to obtain more excellent corrosion resistance, the adhesion amount of Ni is preferably 50 $mg/m^2$ or less. Ni is neither required to cover the whole of porous silica nor required to cover the whole of a portion exposed from silica of the base material.

The adhesion amount of Ni can be measured by using a fluorescent X-ray analysis apparatus. For example, X-ray intensity is measured in advance by using a sample in which an adhesion amount of Ni has been known, a calibration curve indicating a relationship between the adhesion amount of Ni and the X-ray intensity is created, and using this calibration curve makes it possible to specify an adhesion amount of Ni from X-ray intensity in the steel sheet targeted for measurement.

Next, a method of manufacturing the steel sheet according to the embodiment of the present invention will be described. In this method, the hot rolling, the pickling after hot rolling, the cold rolling, the annealing, the pickling after annealing, and the Ni electrolytic plating of the steel having the above-described chemical composition are performed.

The hot rolling, the pickling after hot rolling, and the cold rolling can be performed under general conditions.

The annealing after the cold rolling is performed under a condition that silica and manganese silicate are produced on a surface of a cold-rolled steel sheet obtained by the cold rolling and internal oxidation does not easily occur. As the annealing, continuous annealing is preferably performed. Regulating an amount of silica to be produced by the annealing makes it possible to control the reflectance in the wave number indicating the absorption peak appearing in the range of wave numbers of 1200 $cm^{-1}$ to 1300 $cm^{-1}$ by the FT-IR analysis of the surface of the steel sheet according to this embodiment. The amount of silica to be produced by the annealing can be controlled by regulating a temperature and an atmosphere of the annealing, for example. The higher the temperature of the annealing is, the more silica is produced. The atmosphere of the annealing is preferably controlled by regulating an oxygen potential in a $N_2$ atmosphere including oxygen atoms (O). The higher the oxygen potential is, the more silica is produced, so that the absorptance of infrared rays increases and the reflectance decreases. A method of regulating the amount of silica and the reflectance is not particularly limited. In manufacturing the steel sheet, a condition that a desirable amount of silica is produced, namely a condition that the reflectance in the wave number indicating the absorption peak appearing in the range of wave numbers of 1200 $cm^{-1}$ to 1300 $cm^{-1}$ by the FT-IR analysis is not less than 50% nor more than 85% and preferably not less than 60% nor more than 85% is examined in advance, and this condition is preferably employed. For example, when a $H_2$ concentration is 3% and a dew point is less than −35° C. or more than −20° C. in the $N_2$ atmosphere with an $O_2$ concentration of 50 ppm or less, the reflectance easily decreases.

When the oxygen potential is too high, silica is not easily formed on the surface of the cold-rolled steel sheet and the internal oxidation progresses, and therefore the reflectance in the wave number indicating the absorption peak appearing in the range of wave numbers of 1200 $cm^{-1}$ to 1300 $cm^{-1}$ by the FT-IR analysis increases. The progress of the internal oxidation makes the reduction in the tensile strength and the reduction in the fatigue strength accompanying the decarburization remarkable. A degree of the decarburization can be confirmed based on a thickness of a decarburized layer. For example, when an area fraction of a hard structure at a ¼ thickness of a sheet thickness of the steel sheet is set as S1 and an area fraction of a hard structure in a surface layer portion of the steel sheet is set as S2, a maximum depth in a portion in which a value of a ratio S2/S1 is 0.40 or more can be regarded as the thickness of the decarburized layer. In order to avoid the reduction in the tensile strength and the reduction in the fatigue strength, the thickness of the decarburized layer is preferably 3 μm or less. The hard structure mentioned here means martensite, tempered martensite, bainite or retained austenite, or a structure constituted of an optional combination of these. For example, when the $H_2$ concentration is 3% and the dew point is more than −10° C. in the $N_2$ atmosphere with the $O_2$ concentration of 50 ppm or less, the decarburization is remarkable and there is a possibility that the value of the ratio S2/S1 becomes less than 0.40.

As can be seen from a balanced equation of "$H_2O \longleftrightarrow H_2 + \frac{1}{2}(O_2)$", the higher an $O_2$ concentration is or the higher a $H_2O$ concentration is or the lower a $H_2$ concentration is in the annealing furnace, the higher an oxygen potential in the annealing furnace becomes. The $H_2O$ concentration is sometimes indicated by a water vapor concentration or the dew point.

After the annealing, part or the whole of manganese silicate produced by the annealing is removed by the pickling after annealing. Regulating an amount of manganese silicate remaining after the pickling after annealing makes it possible to control the reflectance in the wave number indicating the absorption peak appearing in the range of wave numbers of 1000 $cm^{-1}$ to 1100 $cm^{-1}$ by the FT-IR analysis of the surface of the steel sheet according to this embodiment. The amount of the remaining manganese silicate can be controlled by regulating a condition of the pickling after annealing, for example. The higher a concentration of acid is or the higher a temperature of acid is or the longer a time when the annealed steel sheet is in contact with acid is, the less manganese silicate becomes. In the pickling after annealing, for example, the surface of the annealed steel sheet is maintained in a wet state with hydrochloric acid whose concentration is 3.0 mass % to 6.0 mass % and whose temperature is 50° C. to 60° C. for three seconds to ten seconds. The wet state with hydrochloric acid can be obtained by immersing the annealed steel sheet in hydrochloric acid, or can also be obtained by spraying hydrochloric acid on the annealed steel sheet. When the concentration of hydrochloric acid is less than 3.0 mass %, manganese silicate is difficult to dissolve. Accordingly, the concentration of hydrochloric acid is preferably 3.0 mass % or more. When the concentration of hydrochloric acid is more than 6.0 mass %, there is a possibility that fine pitting occurs on the surface of the annealed steel sheet. Accordingly, the concentration of hydrochloric acid is preferably 6.0 mass % or less. When the temperature of hydrochloric acid is lower than 50° C., manganese silicate is difficult to dissolve. Accordingly, the temperature of hydrochloric acid is preferably 50° C. or higher. When the temperature of hydrochloric acid is higher than 60° C., there is the possibility that the fine pitting occurs on the surface of the annealed steel sheet. Accordingly, the temperature of hydrochloric acid is preferably 60° C. or lower. When the time when the surface of the annealed steel sheet is wet with hydrochloric acid is shorter than three seconds, manganese silicate is difficult to dissolve. Accordingly, this time is preferably three seconds or longer. When this time is longer than ten seconds, there is the possibility that the fine pitting occurs on the surface of the annealed steel sheet. Accordingly, this time is ten seconds or shorter. The pickling after annealing is preferably performed under a condition that manganese silicate produced by the annealing can be removed and the pitting does not easily occur in the annealed steel sheet, and the above-described example is not restrictive. Even though the pitting occurs, it is preferable that the number of corrosion pits with a depth of 1 μm or more is five pits or less in a field of view with an arbitrary cross-sectional width of 100 μm. The presence of more than five corrosion pits with the depth of 1 μm or more in the field of view with the arbitrary cross-sectional width of 100 μm is because sufficient corrosion resistance cannot be obtained or sufficient fatigue strength cannot be obtained. An acid to be used for the pickling after annealing is not limited to hydrochloric acid. Then, the smaller an amount of manganese silicate is, the larger the reflectance in the wave number indicating the absorption peak appearing in the range of wave numbers of 1000 $cm^{-1}$ to 1100 $cm^{-1}$ by the FT-IR analysis becomes, and when manganese silicate does not exist, the absorption peak does not appear in this range. A method of regulating the amount of manganese silicate and the reflectance is not particularly limited. In manufacturing the steel sheet, a condition that the pitting does not easily occur in the annealed steel sheet and the amount of manganese silicate is in a desirable range, namely a condition that the absorption peak does not appear in the range of wave numbers of 1000 $cm^{-1}$ to 1100 $cm^{-1}$ by the FT-IR analysis or the reflectance in the wave number indicating this absorption peak is 85% or more even though the absorption peak appears, including a type of acid is examined in advance, and this condition is preferably employed.

After the pickling after annealing, Ni is made to adhere to the surface of the annealed steel sheet by the electrolytic plating. As a result, porous silica is covered with Ni. As a treatment solution to be used for the electrolytic plating, for example, a commonly-used treatment solution such as an aqueous nickel sulfate solution, an aqueous nickel chloride solution, or an aqueous nickel carbonate solution can be used. The adhesion amount of Ni can be regulated by changing a concentration of the treatment solution and a current density at a time of the electrolytic plating, for example. As described above, Ni is neither required to cover the whole of porous silica nor required to cover the whole of the portion exposed from silica of the base material.

Thus, the steel sheet according to the embodiment of the present invention can be manufactured.

A use of the steel sheet according to the embodiment of the present invention is not particularly limited. For example, preferably, after being molded by press work or the like, the steel sheet is subjected to conversion treatment such as zinc phosphate treatment and is used. More preferably, electrodeposition coating is performed on a conversion treatment layer formed by the conversion treatment and the steel sheet is used.

Note that the above-described embodiment merely illustrates concrete examples of implementing the present invention, and the technical scope of the present invention is not to be construed in a restrictive manner by these embodiments. That is, the present invention may be implemented in various forms without departing from the technical spirit or main feature thereof.

EXAMPLES

Next, examples of the present invention will be described. Conditions in the examples are condition examples employed for confirming the applicability and effects of the present invention and the present invention is not limited to these condition examples. The present invention can employ various conditions as long as the object of the present invention is achieved without departing from the spirit of the present invention.

In this test, through hot rolling, pickling after hot rolling, and cold rolling of steel having chemical compositions presented in Table 1, cold-rolled steel sheets each having a thickness of 1.2 mm were obtained. Blank columns in Table 1 each indicate that a content of each of elements corresponding thereto is below a detection limit, and the balance is Fe and impurities.

[Table 1]

TABLE 1

| STEEL | CHEMICAL COMPOSITION (MASS %) | | | | | | | | | | | | | | | |
|---|---|---|---|---|---|---|---|---|---|---|---|---|---|---|---|---|
| TYPE | C | Si | Mn | P | S | Al | N | Cr | Mo | Ti | Ni | Cu | Ca | Nb | B | Mg |
| A | 0.131 | 1.19 | 1.92 | 0.009 | 0.0025 | 0.027 | 0.0032 | | | | | | | | | |
| B | 0.073 | 1.76 | 3.06 | 0.016 | 0.0006 | 0.136 | 0.0062 | 0.34 | 0.07 | 0.042 | | | | | | |
| C | 0.269 | 2.07 | 2.26 | 0.007 | 0.0052 | 0.013 | 0.0023 | | | | 0.36 | 0.16 | 0.0022 | | | |
| D | 0.179 | 0.86 | 1.31 | 0.021 | 0.0038 | 0.059 | 0.0036 | | | | | | | 0.014 | 0.0017 | |
| E | 0.218 | 0.32 | 2.72 | 0.012 | 0.0032 | 1.027 | 0.0071 | | | | | | | | | 0.0015 |
| F | 0.026 | 1.57 | 1.96 | 0.012 | 0.0040 | 0.045 | 0.0046 | | | | | | | | | |
| G | 0.142 | 0.04 | 2.19 | 0.015 | 0.0057 | 0.100 | 0.0054 | | | | | | | | | |
| H | 0.174 | 1.47 | 0.42 | 0.008 | 0.0025 | 0.043 | 0.0011 | | | | | | | | | |

Next, the cold-rolled steel sheets were each annealed under a condition that a maximum attained sheet temperature became 820° C. by using a continuous annealing apparatus to obtain an annealed steel sheet. A gas atmosphere in an annealing furnace was set as a $N_2$ atmosphere including $H_2$ and water vapor ($H_2O$). Table 2 presents $H_2$ concentrations at a time of the annealing. An amount of the water vapor was managed by dew points in the furnace presented in Table 2.

Next, pickling after annealing of the annealed steel sheets was performed. In the pickling after annealing, three types of conditions presented in Table 2 were employed. In one condition (weak pickling), hydrochloric acid whose concentration was 5 mass % and whose temperature was 60° C. was sprayed on the annealed steel sheets for six seconds, and thereafter they were water washed. In another condition (first strong pickling), hydrochloric acid whose concentration was 10 mass % and whose temperature was 90° C. was sprayed on the annealed steel sheets for 20 seconds, and thereafter they were water washed. In the other condition (second strong pickling), the annealed steel sheets were immersed in hydrochloric acid whose concentration was 2 mass % and whose temperature was 70° C. for two seconds, and thereafter they were water washed.

Next, Ni was made to adhere to a surface of each of the annealed steel sheets by electrolytic plating. For a plating bath, an aqueous nickel sulfate solution which was regulated so as to be 2 g/L as a Ni concentration was used. A bath temperature was set to 40° C. Adhesion amounts of Ni were regulated by changing voltage. The amounts of adhering Ni were measured by using a fluorescent X-ray analysis apparatus. Table 2 presents the adhesion amounts of Ni.

56 types of steel sheets were produced as described above. Then, a FT-IR analysis of a surface of each of these steel sheets was performed. A FT-IR-6200-type Fourier transform-infrared spectroscopic analyzer manufactured by JASCO Corporation was used for the FT-IR analysis. In the FT-IR analysis, an absorption peak at which a wave number of an infrared absorption spectrum is in a range of 1200 $cm^{-1}$ to 1300 $cm^{-1}$ and an absorption peak at which a wave number thereof is in a range of 1000 $cm^{-1}$ to 1100 $cm^{-1}$ were specified, and reflectances in the wave numbers indicating these absorption peaks were found. Table 2 presents this result. As described above, each of the reflectances in the wave number indicating the absorption peak in the range of wave numbers of 1200 $cm^{-1}$ to 1300 $cm^{-1}$ reflects an amount of silica, and each of the reflectances in the wave number indicating the absorption peak in the range of wave numbers of 1000 $cm^{-1}$ to 1100 $cm^{-1}$ reflects an amount of manganese silicate. Underlines in Table 2 indicate that numeric values thereof deviate from ranges of the present invention.

TABLE 2

| TEST NUMBER | STEEL TYPE | ANNEALING: $H_2$ CONCENTRATION (VOL %) | ANNEALING: DEW POINT (° C.) | PICKLING |
|---|---|---|---|---|
| 1 | A | 1 | −40 | WEAK PICKLING |
| 2 | A | 1 | −30 | WEAK PICKLING |
| 3 | A | 1 | −20 | WEAK PICKLING |
| 4 | A | 1 | −10 | WEAK PICKLING |
| 5 | A | 1 | 0 | WEAK PICKLING |
| 6 | A | 5 | −40 | WEAK PICKLING |
| 7 | A | 5 | −30 | WEAK PICKLING |
| 8 | A | 5 | −20 | WEAK PICKLING |
| 9 | A | 5 | −10 | WEAK PICKLING |
| 10 | A | 5 | 0 | WEAK PICKLING |
| 11 | A | 10 | −40 | WEAK PICKLING |
| 12 | A | 10 | −30 | WEAK PICKLING |
| 13 | A | 10 | −20 | WEAK PICKLING |
| 14 | A | 10 | −10 | WEAK PICKLING |
| 15 | A | 1 | −40 | WEAK PICKLING |
| 16 | A | 1 | −40 | WEAK PICKLING |
| 17 | A | 1 | −40 | WEAK PICKLING |
| 18 | A | 1 | −40 | WEAK PICKLING |
| 19 | A | 1 | −40 | WEAK PICKLING |
| 20 | A | 1 | −40 | FIRST STRONG PICKLING |
| 21 | B | 1 | −40 | WEAK PICKLING |
| 22 | B | 1 | −30 | WEAK PICKLING |
| 23 | B | 1 | −20 | WEAK PICKLING |

TABLE 2-continued

| | | | | |
|---|---|---|---|---|
| 24 | B | 1 | −10 | WEAK PICKLING |
| 25 | B | 1 | 0 | WEAK PICKLING |
| 26 | B | 1 | −40 | WEAK PICKLING |
| 27 | B | 1 | −40 | WEAK PICKLING |
| 28 | B | 1 | −40 | WEAK PICKLING |
| 29 | B | 1 | −40 | WEAK PICKLING |
| 30 | B | 1 | −40 | WEAK PICKLING |
| 31 | B | 1 | −40 | FIRST STRONG PICKLING |
| 32 | C | 1 | −40 | WEAK PICKLING |
| 33 | C | 1 | −30 | WEAK PICKLING |
| 34 | C | 1 | −20 | WEAK PICKLING |
| 35 | C | 1 | −10 | WEAK PICKLING |
| 36 | C | 1 | 0 | WEAK PICKLING |
| 37 | C | 1 | −40 | WEAK PICKLING |
| 38 | C | 1 | −40 | WEAK PICKLING |
| 39 | C | 1 | −40 | WEAK PICKLING |
| 40 | C | 1 | −40 | WEAK PICKLING |
| 41 | C | 1 | −40 | WEAK PICKLING |
| 42 | C | 1 | −40 | FIRST STRONG PICKLING |
| 43 | D | 1 | −40 | WEAK PICKLING |
| 44 | D | 1 | −30 | WEAK PICKLING |
| 45 | D | 1 | −20 | WEAK PICKLING |
| 46 | D | 1 | −10 | WEAK PICKLING |
| 47 | D | 1 | 0 | WEAK PICKLING |
| 48 | D | 1 | −40 | WEAK PICKLING |
| 49 | D | 1 | −40 | WEAK PICKLING |
| 50 | D | 1 | −40 | WEAK PICKLING |
| 51 | D | 1 | −40 | WEAK PICKLING |
| 52 | D | 1 | −40 | WEAK PICKLING |
| 53 | D | 1 | −40 | FIRST STRONG PICKLING |
| 54 | E | 1 | −40 | WEAK PICKLING |
| 55 | F | 1 | −40 | WEAK PICKLING |
| 56 | G | 1 | −40 | WEAK PICKLING |
| 57 | A | 1 | −40 | SECOND STRONG PICKLING |
| 58 | B | 1 | −40 | SECOND STRONG PICKLING |
| 59 | C | 1 | −40 | SECOND STRONG PICKLING |
| 60 | D | 1 | −40 | SECOND STRONG PICKLING |

| TEST | REFLECTANCE (%) | | ADHESION AOMUNT OF Ni | |
|---|---|---|---|---|
| NUMBER | 1200 $cm^{-1}$~1300 $cm^{-1}$ | 1000 $cm^{-1}$~1100 $cm^{-1}$ | ($g/m^2$) | REMARK |
| 1 | 75 | 92 | 40 | INVENTION EXAMPLE |
| 2 | 53 | 82 | 40 | COMPARATIVE EXAMPLE |
| 3 | 58 | 88 | 40 | INVENTION EXAMPLE |
| 4 | 96 | 94 | 40 | COMPARATIVE EXAMPLE |
| 5 | 97 | 93 | 40 | COMPARATIVE EXAMPLE |
| 6 | 85 | 90 | 40 | INVENTION EXAMPLE |
| 7 | 73 | 92 | 40 | INVENTION EXAMPLE |
| 8 | 76 | 92 | 40 | INVENTION EXAMPLE |
| 9 | 57 | 83 | 40 | COMPARATIVE EXAMPLE |
| 10 | 53 | 85 | 40 | INVENTION EXAMPLE |
| 11 | 83 | 94 | 40 | INVENTION EXAMPLE |
| 12 | 80 | 95 | 40 | INVENTION EXAMPLE |
| 13 | 74 | 93 | 40 | INVENTION EXAMPLE |
| 14 | 76 | 93 | 40 | INVENTION EXAMPLE |
| 15 | 75 | 92 | 0 | COMPARATIVE EXAMPLE |
| 16 | 75 | 92 | 3 | INVENTION EXAMPLE |
| 17 | 75 | 92 | 10 | INVENTION EXAMPLE |
| 18 | 75 | 92 | 100 | INVENTION EXAMPLE |
| 19 | 75 | 92 | 200 | COMPARATIVE EXAMPLE |
| 20 | 90 | 92 | 0 | COMPARATIVE EXAMPLE |
| 21 | 76 | 90 | 40 | INVENTION EXAMPLE |
| 22 | 51 | 83 | 40 | COMPARATIVE EXAMPLE |
| 23 | 55 | 90 | 40 | INVENTION EXAMPLE |
| 24 | 93 | 95 | 40 | COMPARATIVE EXAMPLE |
| 25 | 95 | 94 | 40 | COMPARATIVE EXAMPLE |
| 26 | 76 | 90 | 0 | COMPARATIVE EXAMPLE |
| 27 | 76 | 90 | 3 | INVENTION EXAMPLE |
| 28 | 76 | 90 | 10 | INVENTION EXAMPLE |
| 29 | 76 | 90 | 100 | INVENTION EXAMPLE |
| 30 | 76 | 90 | 200 | COMPARATIVE EXAMPLE |
| 31 | 91 | 90 | 0 | COMPARATIVE EXAMPLE |
| 32 | 75 | 90 | 40 | INVENTION EXAMPLE |
| 33 | 53 | 81 | 40 | COMPARATIVE EXAMPLE |
| 34 | 52 | 89 | 40 | INVENTION EXAMPLE |
| 35 | 90 | 94 | 40 | COMPARATIVE EXAMPLE |
| 36 | 93 | 94 | 40 | COMPARATIVE EXAMPLE |

TABLE 2-continued

| | | | | |
|---|---|---|---|---|
| 37 | 75 | 90 | 0 | COMPARATIVE EXAMPLE |
| 38 | 75 | 90 | 3 | INVENTION EXAMPLE |
| 39 | 75 | 90 | 10 | INVENTION EXAMPLE |
| 40 | 75 | 90 | 100 | INVENTION EXAMPLE |
| 41 | 75 | 90 | 200 | COMPARATIVE EXAMPLE |
| 42 | 90 | 90 | 0 | COMPARATIVE EXAMPLE |
| 43 | 80 | 91 | 40 | INVENTION EXAMPLE |
| 44 | 70 | 86 | 40 | INVENTION EXAMPLE |
| 45 | 71 | 88 | 40 | INVENTION EXAMPLE |
| 46 | 94 | 93 | 40 | COMPARATIVE EXAMPLE |
| 47 | 95 | 94 | 40 | COMPARATIVE EXAMPLE |
| 48 | 80 | 91 | 0 | COMPARATIVE EXAMPLE |
| 49 | 80 | 91 | 3 | INVENTION EXAMPLE |
| 50 | 80 | 91 | 10 | INVENTION EXAMPLE |
| 51 | 80 | 91 | 100 | INVENTION EXAMPLE |
| 52 | 80 | 91 | 200 | COMPARATIVE EXAMPLE |
| 53 | 95 | 91 | 0 | COMPARATIVE EXAMPLE |
| 54 | 80 | 91 | 40 | COMPARATIVE EXAMPLE |
| 55 | 80 | 91 | 40 | COMPARATIVE EXAMPLE |
| 56 | 80 | 91 | 40 | COMPARATIVE EXAMPLE |
| 57 | 87 | 93 | 40 | COMPARATIVE EXAMPLE |
| 58 | 88 | 95 | 40 | COMPARATIVE EXAMPLE |
| 59 | 87 | 94 | 40 | COMPARATIVE EXAMPLE |
| 60 | 90 | 95 | 40 | COMPARATIVE EXAMPLE |

Pitting of each of the steel sheets was examined. In this examination, a vicinity of a surface layer of an arbitrary cross section of each of the steel sheets was observed by a scanning electron microscope, the number of corrosion pits with a depth of 1 μm or more which exist in a field of view with an arbitrary cross-sectional width of 100 μm was examined. Table 3 presents this result.

A thickness of a decarburized layer of each of the steel sheets was examined. In this examination, an area fraction S1 of a hard structure at a ¼ thickness of a sheet thickness of each of the steel sheets and an area fraction S2 of a hard structure in a surface layer portion thereof were measured, and a ratio S2/S1 of these was set as the thickness of the decarburized layer. In the measurement of the area fraction S1 and the area fraction S2, a thicknesswise cross section parallel in a rolling direction of each of the steel sheets was set as an observation surface, polishing and nital etching of this observation surface were performed, and an observation was made at a magnification of 500 times to 3000 times by a field emission scanning electron microscope (FE-SEM). At that time, a line parallel to a sheet surface of each of the steel sheets was drawn and a total length L in which a line was superposed on the hard structure was obtained, and a ratio L/L0 to a length L0 of the line was set as the area fraction of the hard structure in the corresponding depth position. Table 3 presents this result.

Evaluation of tensile strength, conversion treatability, and post-coating corrosion resistance of each of the steel sheets was also performed.

In the evaluation of the tensile strength, a JIS No. 5 test piece was cut in a vertical direction in the rolling direction from each of the steel sheets, and a tensile test at normal temperature was performed. Then, in the tensile strength, 780 MPa or more was evaluated as ○, and less than 780 MPa was evaluated as X. Table 3 presents this result.

In the evaluation of the conversion treatability, first, a test piece of 70 mm×150 mm was cut from each of the steel sheets, and degreasing and conversion treatment of this test piece were performed. In the degreasing, an aqueous solution of a degreasing agent which had a concentration of 18 g/L was sprayed on a sample at 40° C. for 120 seconds, and the sample was water washed. As the degreasing agent, Fine Cleaner E2083 manufactured by Nihon Parkerizing Co., Ltd. was used. In the conversion treatment, the test piece was immersed in an aqueous solution of a surface treatment agent which had a concentration of 0.5 g/L at normal temperature for 60 seconds, immersed in a zinc phosphate treatment agent for 120 seconds, water washed, and dried, thereby forming a conversion treatment coating film. As the surface treatment agent, PREPALENE XG manufactured by Nihon Parkerizing Co., Ltd. was used, and as the zinc phosphate treatment agent, PALBOND L3065 manufactured by Nihon Parkerizing Co., Ltd. was used.

Figure 2:
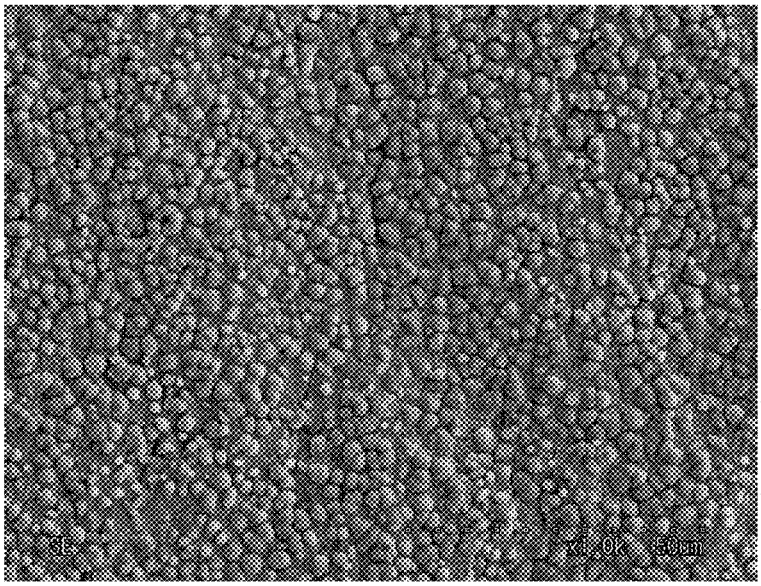
FIG. 2 is a view illustrating a sample in which a degree of adhesion of a crystal of zinc phosphate is good.
Figure 3:
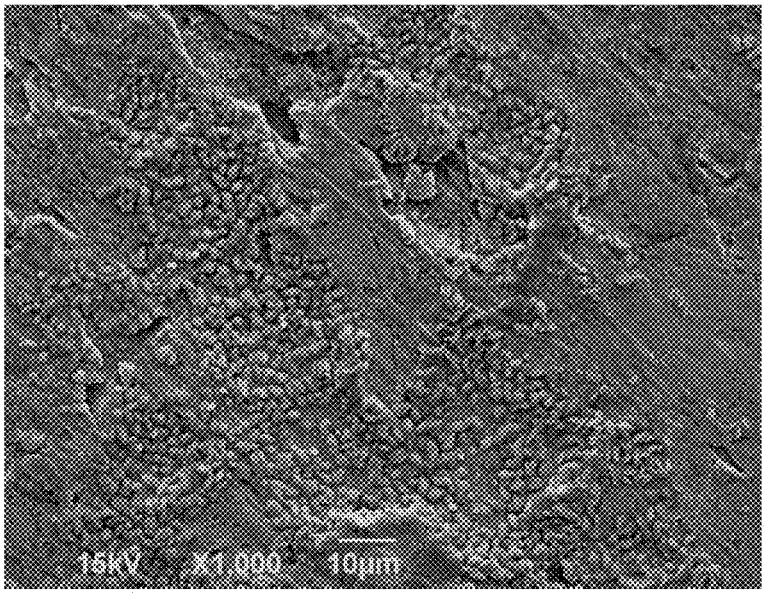
FIG. 3 is a view illustrating a sample in which a degree of adhesion of a crystal of zinc phosphate is poor.

Then, as appearance evaluation of the conversion treatment coating film, three points of an upper portion, a middle portion, and a lower portion of the test piece were observed at a magnification of 1000 times by using the scanning electron microscope (SEM) to observe a degree of adhesion of a crystal of zinc phosphate. Then, in a ratio of a region in which a film of zinc phosphate was not formed, the one having less than 5 area % was evaluated as ○, the one having 5 area % or more and less than 20 area % was evaluated as Δ, and the one having 20 area % or more was evaluated as X. Table 3 presents this result. FIG. 1 illustrates a SEM photograph of a sample evaluated as ○, FIG. 2 illustrates a SEM photograph of a sample evaluated as Δ, and FIG. 3 illustrates a SEM photograph of a sample evaluated as X.

Measurement of an adhesion amount of the conversion treatment coating film was also performed by using fluorescent X-rays. In this measurement, regarding P intensity of the fluorescent X-rays, a calibration curve created in advance by using a steel sheet in which an adhesion amount of a conversion treatment coating film of zinc phosphate had been known was used. The lower the adhesion amount of the conversion treatment coating film is, the lower the conversion treatability is, and as long as the adhesion amount is 2 $g/m^2$ or more, the conversion treatability is good. In this evaluation, in the adhesion amount, the one having 2 $g/m^2$ or more was regarded as ○, the one having 1.5 $g/m^2$ or more and less than 2 $g/m^2$ was regarded as Δ, and the one having less than 1.5 $g/m^2$ was regarded as X. Table 3 presents this result.

In the evaluation of the post-coating corrosion resistance, first, a conversion treatment coating film was formed on each of the steel sheets similarly to the evaluation of the conversion treatability, and the top thereof was coated with electrodeposition paint. As the electrodeposition paint, Power Knicks manufactured by Nippon Paint Co., Ltd. was used. In this coating, voltage was applied in a state of immersing a test piece in the electrodeposition paint with a temperature of 30° C., and a power-on time was regulated so that a thickness of a coating film became 20 μm in dry film thickness at a voltage of 150 V. The power-on time was about three minutes. The film thickness was measured by using an electromagnetic film thickness meter.

Then, an X-shaped cut flaw was formed at the center of the test piece from the top of the coating film by a cutter knife so as to reach the material (steel sheet) of the test piece, and a lateral end surface (side surface) was sealed by a tape, thereby producing a sample for corrosion resistance test. This was subjected to a salt spray test by a method mentioned in JIS Z 2371. A test time was set to 1000 hours, and on one side in a maximum swelling width from the cut flaw, 2 mm or less was evaluated as ○, more than 2 mm and 3 mm or less was evaluated as Δ, and more than 3 mm was evaluated as X. Table 3 presents this result. Underlines in Table 3 indicate that numeric values thereof deviate from a desirable range.

TABLE 3

| TEST NUMBER | NUMBER OF CORROSION PITS (PIECE) | THICKNESS OF DECARBURIZED LAYER (μm) | TENSILE STRENGTH | CONVERSION TREATABILITY | | POST-COATING CORROSION RESISTANCE |
|---|---|---|---|---|---|---|
| | | | | APPEARANCE | ADHESION AMOUNT | |
| 1 | 5 OR LESS | 3 OR LESS | ○ | ○ | ○ | ○ |
| 2 | 5 OR LESS | 3 OR LESS | ○ | X | X | X |
| 3 | 5 OR LESS | 3 OR LESS | ○ | Δ | Δ | Δ |
| 4 | 5 OR LESS | MORE THAN 3 | ○ | ○ | ○ | ○ |
| 5 | 5 OR LESS | MORE THAN 3 | ○ | ○ | ○ | ○ |
| 6 | 5 OR LESS | 3 OR LESS | ○ | ○ | ○ | ○ |
| 7 | 5 OR LESS | 3 OR LESS | ○ | ○ | ○ | ○ |
| 8 | 5 OR LESS | 3 OR LESS | ○ | ○ | ○ | ○ |
| 9 | 5 OR LESS | 3 OR LESS | ○ | X | X | X |
| 10 | 5 OR LESS | 3 OR LESS | ○ | Δ | Δ | Δ |
| 11 | 5 OR LESS | 3 OR LESS | ○ | ○ | ○ | ○ |
| 12 | 5 OR LESS | 3 OR LESS | ○ | ○ | ○ | ○ |
| 13 | 5 OR LESS | 3 OR LESS | ○ | ○ | ○ | ○ |
| 14 | 5 OR LESS | 3 OR LESS | ○ | ○ | ○ | ○ |
| 15 | 5 OR LESS | 3 OR LESS | ○ | X | X | X |
| 16 | 5 OR LESS | 3 OR LESS | ○ | Δ | Δ | Δ |
| 17 | 5 OR LESS | 3 OR LESS | ○ | ○ | ○ | ○ |
| 18 | 5 OR LESS | 3 OR LESS | ○ | ○ | ○ | Δ |
| 19 | 5 OR LESS | 3 OR LESS | ○ | ○ | ○ | X |
| 20 | MORE THAN 5 | 3 OR LESS | ○ | ○ | ○ | Δ |
| 21 | 5 OR LESS | 3 OR LESS | ○ | ○ | ○ | ○ |
| 22 | 5 OR LESS | 3 OR LESS | ○ | X | X | X |
| 23 | 5 OR LESS | 3 OR LESS | ○ | Δ | Δ | Δ |
| 24 | 5 OR LESS | MORE THAN 3 | ○ | ○ | ○ | ○ |
| 25 | 5 OR LESS | MORE THAN 3 | ○ | ○ | ○ | ○ |
| 26 | 5 OR LESS | 3 OR LESS | ○ | X | X | X |
| 27 | 5 OR LESS | 3 OR LESS | ○ | Δ | Δ | Δ |
| 28 | 5 OR LESS | 3 OR LESS | ○ | ○ | ○ | ○ |
| 29 | 5 OR LESS | 3 OR LESS | ○ | ○ | ○ | Δ |
| 30 | 5 OR LESS | 3 OR LESS | ○ | ○ | ○ | X |
| 31 | MORE THAN 5 | 3 OR LESS | ○ | ○ | ○ | Δ |
| 32 | 5 OR LESS | 3 OR LESS | ○ | ○ | ○ | ○ |
| 33 | 5 OR LESS | 3 OR LESS | ○ | X | X | X |
| 34 | 5 OR LESS | 3 OR LESS | ○ | Δ | Δ | Δ |
| 35 | 5 OR LESS | MORE THAN 3 | ○ | ○ | ○ | ○ |
| 36 | 5 OR LESS | MORE THAN 3 | ○ | ○ | ○ | ○ |
| 37 | 5 OR LESS | 3 OR LESS | ○ | X | X | X |
| 38 | 5 OR LESS | 3 OR LESS | ○ | Δ | Δ | Δ |
| 39 | 5 OR LESS | 3 OR LESS | ○ | ○ | ○ | ○ |
| 40 | 5 OR LESS | 3 OR LESS | ○ | ○ | ○ | Δ |
| 41 | 5 OR LESS | 3 OR LESS | ○ | ○ | ○ | X |
| 42 | MORE THAN 5 | 3 OR LESS | ○ | ○ | ○ | Δ |
| 43 | 5 OR LESS | 3 OR LESS | ○ | ○ | ○ | ○ |
| 44 | 5 OR LESS | 3 OR LESS | ○ | ○ | ○ | ○ |
| 45 | 5 OR LESS | 3 OR LESS | ○ | ○ | ○ | ○ |
| 46 | 5 OR LESS | MORE THAN 3 | ○ | ○ | ○ | ○ |
| 47 | 5 OR LESS | MORE THAN 3 | ○ | ○ | ○ | ○ |
| 48 | 5 OR LESS | 3 OR LESS | ○ | X | X | X |
| 49 | 5 OR LESS | 3 OR LESS | ○ | Δ | Δ | Δ |
| 50 | 5 OR LESS | 3 OR LESS | ○ | ○ | ○ | ○ |
| 51 | 5 OR LESS | 3 OR LESS | ○ | ○ | ○ | Δ |
| 52 | 5 OR LESS | 3 OR LESS | ○ | ○ | ○ | X |
| 53 | MORE THAN 5 | 3 OR LESS | ○ | ○ | ○ | Δ |
| 54 | 5 OR LESS | 3 OR LESS | X | ○ | ○ | ○ |
| 55 | 5 OR LESS | 3 OR LESS | X | ○ | ○ | ○ |
| 58 | 5 OR LESS | 3 OR LESS | X | ○ | ○ | ○ |
| 57 | MORE THAN 5 | 3 OR LESS | ○ | ○ | ○ | Δ |
| 58 | MORE THAN 5 | 3 OR LESS | ○ | ○ | ○ | Δ |

TABLE 3-continued

| | | | | | | |
|---|---|---|---|---|---|---|
| 59 | MORE THAN 5 | 3 OR LESS | ○ | ○ | ○ | Δ |
| 60 | MORE THAN 5 | 3 OR LESS | ○ | ○ | ○ | Δ |

| TEST NUMBER | OTHER CHARACTERISTICS | REMARK |
|---|---|---|
| 1 | | INVENTION EXAMPLE |
| 2 | | COMPARATIVE EXAMPLE |
| 3 | | INVENTION EXAMPLE |
| 4 | FATIGUE STRENGTH REDUCTION | COMPARATIVE EXAMPLE |
| 5 | FATIGUE STRENGTH REDUCTION | COMPARATIVE EXAMPLE |
| 6 | | INVENTION EXAMPLE |
| 7 | | INVENTION EXAMPLE |
| 8 | | INVENTION EXAMPLE |
| 9 | | COMPARATIVE EXAMPLE |
| 10 | | INVENTION EXAMPLE |
| 11 | | INVENTION EXAMPLE |
| 12 | | INVENTION EXAMPLE |
| 13 | | INVENTION EXAMPLE |
| 14 | | INVENTION EXAMPLE |
| 15 | | COMPARATIVE EXAMPLE |
| 16 | | INVENTION EXAMPLE |
| 17 | | INVENTION EXAMPLE |
| 18 | | INVENTION EXAMPLE |
| 19 | | COMPARATIVE EXAMPLE |
| 20 | BENDING WORKABILITY REDUCTION | COMPARATIVE EXAMPLE |
| 21 | | INVENTION EXAMPLE |
| 22 | | COMPARATIVE EXAMPLE |
| 23 | | INVENTION EXAMPLE |
| 24 | FATIGUE STRENGTH REDUCTION | COMPARATIVE EXAMPLE |
| 25 | FATIGUE STRENGTH REDUCTION | COMPARATIVE EXAMPLE |
| 26 | | COMPARATIVE EXAMPLE |
| 27 | | INVENTION EXAMPLE |
| 28 | | INVENTION EXAMPLE |
| 29 | | INVENTION EXAMPLE |
| 30 | | COMPARATIVE EXAMPLE |
| 31 | BENDING WORKABILITY REDUCTION | COMPARATIVE EXAMPLE |
| 32 | | INVENTION EXAMPLE |
| 33 | | COMPARATIVE EXAMPLE |
| 34 | | INVENTION EXAMPLE |
| 35 | FATIGUE STRENGTH REDUCTION | COMPARATIVE EXAMPLE |
| 36 | FATIGUE STRENGTH REDUCTION | COMPARATIVE EXAMPLE |
| 37 | | COMPARATIVE EXAMPLE |
| 38 | | INVENTION EXAMPLE |
| 39 | | INVENTION EXAMPLE |
| 40 | | INVENTION EXAMPLE |
| 41 | | COMPARATIVE EXAMPLE |
| 42 | BENDING WORKABILITY REDUCTION | COMPARATIVE EXAMPLE |
| 43 | | INVENTION EXAMPLE |
| 44 | | INVENTION EXAMPLE |
| 45 | | INVENTION EXAMPLE |
| 46 | FATIGUE STRENGTH REDUCTION | COMPARATIVE EXAMPLE |
| 47 | FATIGUE STRENGTH REDUCTION | COMPARATIVE EXAMPLE |
| 48 | | COMPARATIVE EXAMPLE |
| 49 | | INVENTION EXAMPLE |
| 50 | | INVENTION EXAMPLE |
| 51 | | INVENTION EXAMPLE |
| 52 | | COMPARATIVE EXAMPLE |
| 53 | BENDING WORKABILITY REDUCTION | COMPARATIVE EXAMPLE |
| 54 | | COMPARATIVE EXAMPLE |
| 55 | | COMPARATIVE EXAMPLE |
| 58 | | COMPARATIVE EXAMPLE |
| 57 | BENDING WORKABILITY REDUCTION | COMPARATIVE EXAMPLE |
| 58 | BENDING WORKABILITY REDUCTION | COMPARATIVE EXAMPLE |
| 59 | BENDING WORKABILITY REDUCTION | COMPARATIVE EXAMPLE |
| 60 | BENDING WORKABILITY REDUCTION | COMPARATIVE EXAMPLE |

In test numbers 1, 3, 6 to 8, 10 to 14, 16 to 18, 21, 23, 27 to 29, 32, 34, 38 to 40, 43 to 45, and 49 to 51, excellent conversion treatability and post-coating corrosion resistance were obtained since their numeric values were in ranges of the present invention. In test numbers 1, 6 to 8, 11 to 14, 16 to 18, 21, 27 to 29, 32, 38 to 40, 43 to 45, and 49 to 51 in which the reflectance in the wave number indicating the absorption peak appearing in the range of wave numbers of 1200 $cm^{-1}$ to 1300 $cm^{-1}$ by the FT-IR analysis was not less than 60% nor more than 85%, particularly excellent conversion treatability and post-coating corrosion resistance were obtained.

In test numbers 2, 9, 22, and 33, since the reflectance in the wave number indicating the absorption peak appearing in the range of wave numbers of 1000 $cm^{-1}$ to 1100 $cm^{-1}$ by the FT-IR analysis was less than 85%, the conversion treatability was low, and the post-coating corrosion resistance was also low following this. It is thought because a large amount of manganese silicate remains.

In test numbers 15, 26, 37, and 48, since the adhesion amount of Ni was less than 3 $mg/m^2$, the conversion treatability was low, and the post-coating corrosion resistance was also low following this. In test numbers 19, 30, 41, and 52, since the adhesion amount of Ni was more than 100 $g/m^2$, good conversion treatability was obtained, but the post-coating corrosion resistance was low.

In test numbers 4, 5, 24, 25, 35, 36, 46, and 47, since the annealing was performed under such a condition that decarburization occurred intentionally, namely since the annealing was performed in an atmosphere having a high dew point and a high oxygen potential, a thick decarburized layer was formed. Therefore, fatigue strength is reduced. In addition, the reflectance in the wave number indicating the absorption peak appearing in the range of wave numbers of 1200 $cm^{-1}$ to 1300 $cm^{-1}$ by the FT-IR analysis was more than 85%.

In test numbers 20, 31, 42, and 53, since the pickling after annealing was performed under a condition that pitting easily occurred intentionally, namely since the first strong pickling was performed, much pitting occurred. Therefore, bending workability is reduced. In addition, the reflectance in the wave number indicating the absorption peak appearing in the range of wave numbers of 1200 $cm^{-1}$ to 1300 $cm^{-1}$ by the FT-IR analysis was more than 85%.

In test numbers 54 to 56, since a composition of steel deviated from the range of the present invention, the tensile strength was low.

Also in test numbers 57 to 60, since the pickling after annealing was performed under the condition that pitting easily occurred intentionally, namely since the second strong pickling was performed, much pitting occurred. Therefore, the bending workability is reduced. In addition, the reflectance in the wave number indicating the absorption peak appearing in the range of wave numbers of 1200 $cm^{-1}$ to 1300 $cm^{-1}$ by the FT-IR analysis was more than 85%.

INDUSTRIAL APPLICABILITY

The present invention can be utilized in an industry related to a steel sheet suitable for a vehicle body and parts of an automobile, for example.

The invention claimed is:

1. A steel sheet comprising a chemical composition represented by, in mass %, C: 0.050% to 0.400%, Si: 0.10% to 2.50%, Mn: 1.20% to 3.50%, P: 0.100% or less, Al: 1.200% or less, N: 0.0100% or less, Cr, Mo, Ni and Cu: 0.00% to 1.20% in total, Nb, Ti and V: 0.000% to 0.200% in total, B: 0.0000% to 0.0075%, Ca, Mg, Hf, Zr, Sb and REM: 0.0000% to 0.1000% in total, and the balance: Fe and impurities, in which a surface exhibits an absorption peak at which a reflectance is not less than 50% nor more than 85% in a range of wave numbers of 1200 $cm^{-1}$ to 1300 $cm^{-1}$ by a Fourier transform-infrared spectroscopy analysis by a reflection absorption spectrometry method, and exhibits an absorption peak at which a reflectance is either 0% or 85% or more in the range of wave numbers of 1000 $cm^{-1}$ to 1100 $cm^{-1}$, wherein Ni of 40 $mg/m^2$ to 100 $mg/m^2$ adheres to the surface, and a thickness of a decarburized layer is 3 μm or less.

2. The steel sheet according to claim 1, wherein the surface exhibits an absorption peak at which a reflectance is not less than 60% nor more than 85% in the range of wave numbers of 1200 $cm^{-1}$ to 1300 $cm^{-1}$ by the Fourier transform-infrared spectroscopy analysis by the reflection absorption spectrometry method.

* * * * *